US005505353A

United States Patent [19]

Marsh, Jr.

[11] Patent Number: 5,505,353

[45] **Date of Patent: *Apr. 9, 1996**

[54] STRAP SUSPENSION HAVING AN ADJUSTABLE RECEPTACLE FOR CONTAINERS

[76] Inventor: John R. Marsh, Jr., 8208 Noland Rd., Lenexa, Kans. 66215

[ * ] Notice: The term of this patent shall not extend beyond the expiration date of Pat. No. 5,407,110.

[21] Appl. No.: 378,287

[22] Filed: Jan. 26, 1995

Related U.S. Application Data

[63] Continuation-in-part of Ser. No. 214,196, Mar. 17, 1994, Pat. No. 5,407,110.

[51] Int. Cl.[6] ..... A45F 5/00

[52] U.S. Cl. ..... 224/148; 224/250; 224/257; 224/205

[58] Field of Search ..... 224/148, 202, 224/205, 206, 257, 258, 250, 901; 294/149, 150, 157

[56] References Cited

U.S. PATENT DOCUMENTS

| | | | |
|---|---|---|---|
| 2,550,554 | 4/1951 | Griffin . | |
| 2,733,845 | 2/1956 | Brio . | |
| 4,096,977 | 6/1978 | Barville et al. . | |
| 4,127,223 | 11/1978 | Uchin | 224/257 X |
| 4,629,153 | 12/1986 | Marcum . | |
| 4,669,643 | 6/1987 | Ley | 224/257 |
| 4,993,611 | 2/1991 | Longo . | |
| 5,147,079 | 9/1992 | Heather | 224/148 |
| 5,167,354 | 12/1992 | Conhanfard . | |

OTHER PUBLICATIONS

*The Wall Street Journal,* Marketplace, "Inside Santa's Bag: Some Bizarre Gifts", Nov. 29, 1993, p. B1.

*Primary Examiner*—J. Casimer Jacyna
*Attorney, Agent, or Firm*—Litman, McMahon and Brown

[57] ABSTRACT

A neck strap suspension has an adjustable receptacle for receiving beverage containers of various sizes. The strap suspension includes an adjustable-length neck strap assembly. Upper and lower girth strap assemblies are adjustably connected to the neck strap assembly in vertically-spaced relation to define a receptacle having an adjustable depth. The girth strap assemblies include fasteners which can lengthen or shorten the girth straps to fit containers of various diameters. The girth strap assembly fasteners are selectively releasable for placing the girth strap assemblies in open configurations.

11 Claims, 2 Drawing Sheets

STRAP SUSPENSION HAVING AN ADJUSTABLE RECEPTACLE FOR CONTAINERS

This application is a continuation-in-part of U.S. patent application Ser. No. 08/214,196, entitled STRAP SUSPENSION FOR CONTAINERS, filed Mar. 17, 1994, now U.S. Pat. No. 5,407,110. The subject matter of the parent application is expressly incorporated herein by reference.

BACKGROUND OF THE INVENTION

1. Field of the Invention

The present invention relates generally to wearable suspensions for containers, and in particular to a neck suspension for containers in insulated holders.

2. Description of the Related Art

Various types of vessels and containers have heretofore been devised for facilitating the consumption of different types of beverages in a wide range of situations. Beverages in closed containers, such as cans and bottles, are currently very popular. Such pre-packaged beverages offer convenience and portability.

Insulated holders are a common accessory for beverage containers. A typical container holder comprises a resilient, insulating material, such as foam rubber. Such holders can provide insulation for maintaining beverage temperatures for longer periods than would be possible with uninsulated containers in ambient conditions. Such holders can also protect a container, such as a glass bottle, against breakage.

After a beverage container is opened, a certain degree of care of must normally be exercised to avoid spilling the contents. However, holding an open beverage container can be inconvenient in some circumstances, such as those wherein a person is engaged in sports or other physical activity. In spite of the inconvenience, persons engaged in physical activity often prefer to have a beverage close at hand for replenishment of lost fluids, etc. For example, persons engaged in cycling, canoeing, rafting, fishing and other sports may benefit from the availability of a beverage without the hinderance of having to hold its container. Moreover, persons engaged in manual labor of various types may benefit from the availability of a beverage, particularly if a no-hands suspension is available for the beverage container which would minimize interference with the task at hand.

Previous devices which addressed this problem include those disclosed in the Griffin U.S. Pat. No. 2,550,554; the Barville et al. U.S. Pat. No. 4,096,977; the Longo U.S. Pat. No. 4,993,611 and the Cohanfard U.S. Pat. No. 5,167,354.

However, heretofore there has not been available a strap suspension for containers with the advantages and features of the present invention.

SUMMARY OF THE INVENTION

In the practice of the present invention, a wearable neck strap suspension is provided for containers in insulated holders. The suspension includes a length-adjustable neck strap assembly. Upper and lower girth strap assemblies are adjustably coupled to the neck strap assembly and define therewith a receptacle having an adjustable depth adapted to receive a container within a holder. The girth strap assemblies have open and closed configurations for retaining and releasing the containers within holders in the receptacle. The girth strap assemblies include releasable, length-adjustable fasteners for altering their configurations between opened and closed and for adjustment to fit containers of varying diameters.

OBJECTS AND ADVANTAGES OF THE INVENTION

The principal objects and advantages of the present invention include: providing a strap suspension for containers; providing such a suspension which is wearable; providing such a suspension which is adapted for receiving containers within insulated holders; providing such a suspension which is adapted for suspending a container on a wearer while leaving the hands free; providing such a suspension which is adapted for suspending a container on a wearer in a convenient position; providing such a suspension which is adjustable to accommodate various wearers and various containers and holders; providing such a suspension which can be easily manufactured from a variety of materials; providing such a suspension which facilitates various activities; and providing such a suspension which is economical to manufacture, efficient in operation, capable of a long operating life and particularly well adapted for the proposed use thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
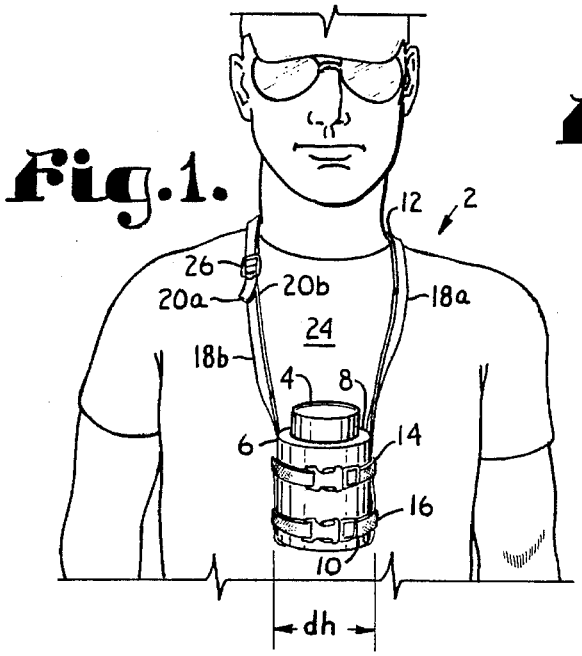
FIG. 1 is a frontal perspective view of a strap suspension embodying the present invention, shown with a container and an insulated holder receiving same and suspended from the neck of a wearer.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a strap suspension for a container 4 and a container holder 6 which receives same. The container 4 can comprise cans, bottles, cartons, etc. of various sizes and configurations. The container holder 6 likewise can assume various sizes and shapes. Without limitation on the generality of useful container holders, the holder 6 can have a generally tubular configuration with an open top 8 and a bottom 10 which is at least partially enclosed. The holder 6 can comprise a suitable compressible, insulating material, such as foam rubber. The holder 6 has an un-compressed diameter dh. Such holders are well known in the art and are generally adapted to receive a beverage container, such as a can or bottle, in a relatively secure engagement.

The suspension 2 generally consists of a neck strap assembly 12 and upper and lower girth strap assemblies 14, 16 respectively.

II. Neck Strap Assembly 12

The neck strap assembly 12 includes first and second neck strap sections 18*a*, 18*b* with respective upper ends 20*a*, 20*b* and lower ends 22*a*, 22*b*. The first neck strap section 18*a* is longer than the neck strap section 18*b* whereby the neck strap upper ends 20*a*, 20*b* will normally intersect at a location near the wearer's upper chest 24. A slide-type fastener or buckle 26 is fixedly mounted on one of the strap section upper ends 20*a*, 20*b* and slidably receives the other strap section 18*a*, 18*b* adjacent to the upper end 20*a* or 20*b* thereof whereby the neck strap assembly 12 is length-adjustable.

The neck section lower ends 22*a*, 22*b* are releasably connected by suitable fastening means, such as a hook-and-loop fastener 28 comprising a hook portion 30 on one of the neck section lower ends 22 and a loop portion 32 on the other neck section lower end 22*a*, 22*b*.

III. Girth Strap Assemblies 14, 16

Figure 2:
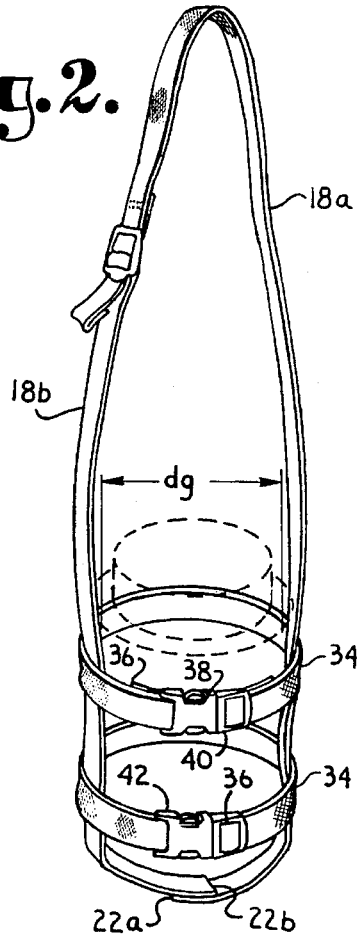
FIG. 2 is a frontal perspective view of the suspension with a container and insulated holder therefor shown in phantom lines.
Figure 3:
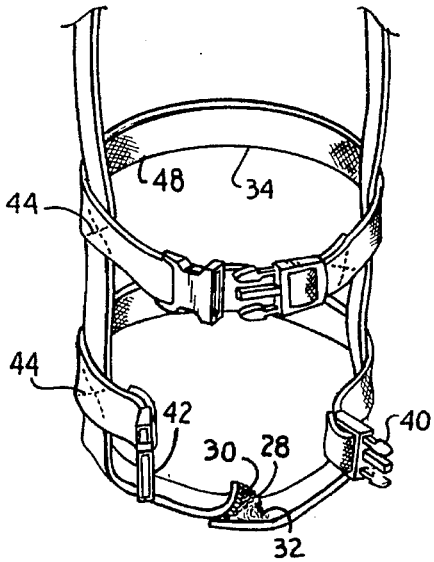
FIG. 3 is a fragmentary, upper, frontal perspective view of the suspension, showing girth strap assemblies thereof in their open configurations.

Each girth strap assembly 14, 16 includes a girth strap 34 with opposite ends 36. A bayonet-type fastener 28 includes male and female sections 40, 42 which are engageable in a fastener closed configuration (FIG. 2) and disengageable in a fastener open position (FIG. 3).

The neck strap assembly 12 is attached to the girth strap assemblies 14, 16 by suitable fastening means 44, such as the cross-stitching 44 shown. Each girth strap assembly 14 is thus fastened to the neck strap assembly 12 by a pair of fastening means which are positioned at locations which are generally diametrically opposite each other with the respective girth strap assembly 14, 16 in its closed configuration.

With the girth strap assemblies 14, 16 in their closed positions, each defines a diameter dg which is less than the uncompressed diameter dh of the folder 6. The girth strap assemblies 14, 16 can thus be sized to securely retain the holder 6 and the container therein. This cooperation between the girth strap assemblies 14, 16 and the holder 6 could also be achieved by providing the girth strap assemblies with length-adjusting buckles.

The girth strap assemblies 14, 16 and the lower portion of the neck strap assembly 12 form an open-top receptacle 48 for the holder 6. The receptacle 48 can be opened by opening the fasteners 38 and thereby placing the girth strap assemblies 14, 16 in their respective open positions, and also by disengaging the hook-and-loop fastener 28 to downwardly open the receptacle 48. The depth of receptacle 48 can be adjusted by means of a hook-and-loop fastener 28 which permits adjusting the length of the neck strap assembly 12 below the lower girth strap assembly 16.

When worn as shown in FIG. 1, the strap suspension 2 places a container 4 within easy reach, but leaves the wearer's hands free for various activities.

IV. Operation

In operation, the strap suspension 2 is adjustable to accommodate various containers 4 and holders 6 therefor. Since many such container holders 6 comprise a compressible material such as foam rubber, the girth strap assemblies 14, 16 can have fixed diameters dg and, by compressing the holders 6, accommodate holders 6 with diameters dh, thereby securely retaining the containers 4 and the holders 6.

The neck strap assembly 12 is length-adjustable above the upper girth strap assembly 14 by means of the buckle 26.

V. First Modified Embodiment

Figure 4:
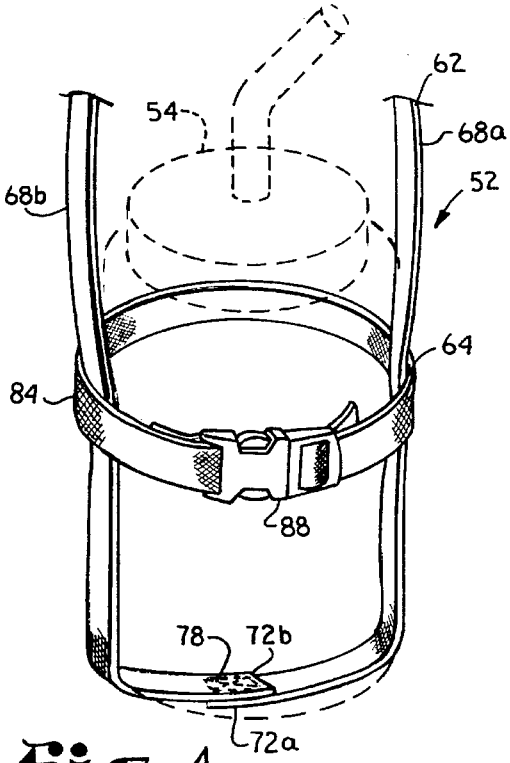
FIG. 4 is a fragmentary, upper, frontal perspective view of a strap suspension for containers comprising a first modified or alternative embodiment of the present invention; a container therein is shown in phantom lines.

A strap suspension 52 for a container 54 is shown in FIG. 4 and comprises a modified or alternative embodiment of the suspension 2. The suspension 52 includes a single girth strap assembly 64 with a length-adjustable bayonet-type fastener 88 for length-adjusting a girth strap 84. A neck strap assembly 62 is fastened together at lower ends 72*a*, 72*b* of neck strap sections 68*a*, 68*b* thereof by cross-stitching 78.

Other than the alternative features shown and described, the strap suspension 52 can be constructed and operated in a manner similar to the strap suspension 2. Moreover, features of the strap suspension 2 could be incorporated in the strap suspension 52 and vice-versa.

VI. Second Modified Embodiment

Figure 5:
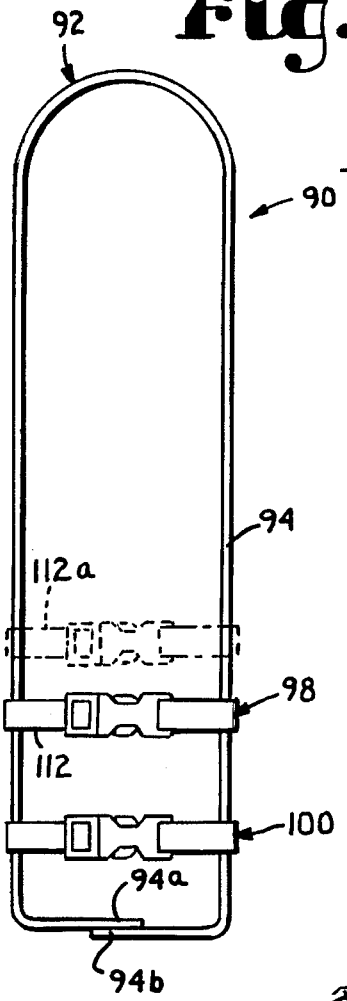
FIG. 5 is a front plan view of an alternate embodiment of the present invention with the adjusted position of a girth strap shown in phantom.
Figure 6:
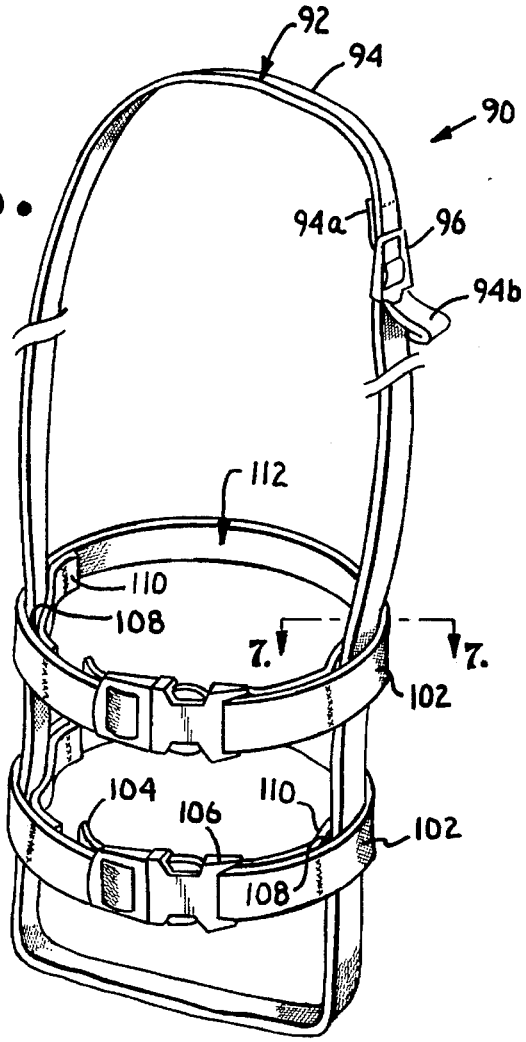
FIG. 6 is a perspective view of an alternate embodiment of the present invention.
Figure 7:
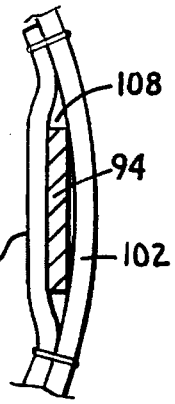
FIG. 7 is a cross sectional view taken along line 7—7 of FIG. 6.

As best shown in FIG. 5, a second modified strap suspension 90 includes a neck strap assembly 92 having a single strap 94 with ends 94*a*, 94*b*. Ends 94*a*, 94*b* may be fixedly coupled, for example, by sewing or fusion welding, or they may be releasably coupled, by mated hook and loop fasteners as depicted in FIG. 3, snaps, or other suitable means. In preferred embodiments, the coupled ends are positioned beneath girth strap assembly 98 as depicted in FIG. 5. However, as those skilled in the art will appreciate, coupled ends 94*a*, 94*b* may be positioned at any suitable location along neck strap assembly 92. Alternatively, as best shown in FIG. 6, a slide-type fastener or buckle 96 is fixedly mounted on strap end 94*a* for slidably receiving strap end 94*b*, whereby the neck strap assembly is length adjustable. In still other embodiments, a sectional strap assembly as depicted in FIG. 2 may be employed.

Each girth strap assembly 98, 100 includes one or more girth straps 102 having opposed ends 104 intercoupled by a fastener 106. A bayonet-type, conventional buckle, or any other similar fastener may be employed for lengthening or shortening the girth straps 102 to fit containers of various diameters. Each girth strap 102 includes a pair of channels 108 for receiving the neck strap 94 therethrough. Channels 108 are positioned at spaced locations generally diametrically opposite each other when the girth strap assemblies 98, 100 are in the closed configuration.

Channels 108 comprise mated channel straps 110 congruently coupled with the girth strap 102 by stitching or fusion welding at intervals spaced to accommodate passage of neck strap 94. In preferred embodiments, one or both girth strap ends 104 may be extended to form channel strap 110. In this manner, girth strap assemblies 98, 100 and the lowermost portion of neck strap 94 cooperatively form an open-top receptacle 112 for receiving a container 4, or combination of container 4 and holder 6.

In use, the strap suspension 90 is operated in a manner similar to that previously described for strap suspension 2. Girth strap fasteners 106 may be employed to lengthen or shorten the girth straps 102 to accommodate containers and holders of various diameters. As best shown in FIG. 5, girth strap assembly 98 may be moved upwardly along neck strap 94 by sliding the channels 108 over the neck strap to form a deeper receptacle 112a to accommodate tall containers. Similarly, girth strap assembly 100 may also be moved upwardly along neck strap 94, or it may be left in place. In this manner, the girth strap assemblies may be independently adjusted to provide support at the top as well as at the base of a wide variety of containers and holders.

Those skilled in the art will appreciate that the adjustable girth strap assembly depicted in FIGS. 5 and 6 can be combined with the sectional neck strap assembly depicted in FIG. 2.

It is to be understood that while certain forms of the present invention have been illustrated and described herein, it is not to be limited to the specific forms or arrangement of parts described and shown.

What is claimed and desired to be secured by Letters Patent is as follows:

1. A strap suspension for containers, comprising:

(a) a neck strap assembly including first and second ends connected in an overlapping spaced relation to each other to form a closed loop;

(b) an upper girth strap assembly with opposite ends, said upper girth strap assembly being fixedly connected to said neck strap at spaced intervals from said girth strap ends whereby a portion of said neck strap loop depends below said upper girth strap assembly;

(c) releasable fastening means for selectively fastening said girth strap ends, said girth strap assembly having a closed configuration with said fastening means fastened and an open configuration with said fastening means unfastened;

(d) said girth strap assembly and said depending neck strap loop portion cooperatively forming an upwardly-open, container-receiving receptacle; and (e) wherein said neck strap first and second ends are connected in a vertically spaced relation to each other below said girth strap assembly.

2. The strap suspension according to claim 1, which includes:

(a) a lower girth strap assembly including opposite ends, said lower girth strap assembly being connected to said neck strap assembly in spaced relation below said upper girth strap assembly; and (b) releasable fastening means for selectively fastening said lower girth strap ends, said lower girth strap assembly having a closed configuration with said fastening means fastened and an open configuration with said fastening means unfastened.

3. The strap suspension according to claim 1, wherein:

(a) said upper girth strap assembly fastening means includes length-adjusting means for length-adjusting said upper girth strap assembly.

4. The strap suspension according to claim 1, wherein:

(a) said neck strap assembly further includes third and fourth ends; and (b) a buckle interconnects said third and fourth ends to form a closed loop, said buckle including length-adjusting means for length-adjusting said neck strap assembly.

5. A strap suspension for containers, comprising:

(a) a neck strap assembly including first and second ends connected in an overlapping spaced relation to each other to form a closed loop;

(b) an upper girth strap assembly with opposite ends, said upper girth strap assembly being adjustably connected to said neck strap at spaced intervals from said girth strap ends whereby a variable portion of said neck strap loop depends below said upper girth strap assembly;

(c) releasable fastening means for selectively fastening said girth strap ends, said girth strap assembly having a closed configuration with said fastening means fastened and an open configuration with said fastening means unfastened;

(d) said girth strap assembly and said depending neck strap variable loop portion cooperatively forming an upwardly-open, container-receiving receptacle having an adjustable depth; and (e) wherein said neck strap first and second ends are connected in a vertically spaced relation to each other below said girth strap assembly.

6. The strap suspension according to claim 5, which includes:

(a) a lower girth strap assembly including opposite ends, said lower girth strap assembly being connected to said neck strap assembly in spaced relation below said upper girth strap assembly; and (b) releasable fastening means for selectively fastening said lower girth strap ends, said lower girth strap assembly having a closed configuration with said fastening means fastened and an open configuration with said fastening means unfastened.

7. The strap suspension according to claim 5, wherein:

(a) said upper girth strap assembly fastening means includes length-adjusting means for length-adjusting said upper girth strap assembly.

8. The strap suspension according to claim 5 wherein:

(a) said neck strap assembly further includes third and fourth ends; and (b) a buckle interconnects said third and fourth ends to form a closed loop, said buckle including length-adjusting means for length-adjusting said neck strap assembly.

9. A strap suspension for containers, comprising:

(a) a neck strap assembly including first and second ends and a buckle interconnecting said first and second ends to form a closed loop, said buckle including length-adjusting means for length-adjusting said neck strap assembly;

(b) an upper girth strap assembly with opposite ends, said upper girth strap assembly being adjustably connected to said neck strap at two different connection points, said connection points being positioned at spaced intervals from said girth strap ends, said upper girth strap being adjustable relative to said neck strap assembly at both of said connection points, whereby a variable portion of said neck strap loop depends below said upper girth strap assembly;

(c) releasable fastening means for selectively fastening said girth strap ends, said girth strap assembly having a closed configuration with said fastening means fastened and an open configuration with said fastening means unfastened; and (d) said girth strap assembly and said depending neck strap variable loop portion cooperatively forming an upwardly-open, container-receiving receptacle having an adjustable depth.

10. The strap suspension according to claim 9, which includes:

(a) a lower girth strap assembly including opposite ends, said lower girth strap assembly being connected to said neck strap assembly in spaced relation below said upper girth strap assembly; and (b) releasable fastening means for selectively fastening said lower girth strap ends, said lower girth strap assembly having a closed configuration with said fastening means fastened and an open configuration with said fastening means unfastened.

11. The strap suspension according to claim 9, wherein:

(a) said girth strap assembly fastening means includes length-adjusting means for length-adjusting said upper girth strap assembly.

* * * * *